US006888489B2

(12) United States Patent
Agler

(10) Patent No.: US 6,888,489 B2
(45) Date of Patent: May 3, 2005

(54) RF SHIELDING ELIMINATION FOR LINEAR ARRAY SAR RADAR SYSTEMS

(75) Inventor: Robert Cordell Agler, Edmond, OK (US)

(73) Assignee: Northrop Grumman Corporation, Los Angeles, CA (US)

( * ) Notice: Subject to any disclaimer, the term of this patent is extended or adjusted under 35 U.S.C. 154(b) by 212 days.

(21) Appl. No.: 10/601,904

(22) Filed: Jun. 23, 2003

(65) Prior Publication Data

US 2004/0257261 A1 Dec. 23, 2004

(51) Int. Cl.[7] ..... H01Q 17/00
(52) U.S. Cl. ..... 342/1; 342/2; 342/4
(58) Field of Search ..... 342/1–20, 25, 342/70; 343/872, 892

(56) References Cited

U.S. PATENT DOCUMENTS

| | | | | |
|---|---|---|---|---|
| 5,400,043 A | | 3/1995 | Arceneaux et al. | |
| 5,525,988 A | * | 6/1996 | Perkins et al. | 342/4 |
| 5,982,339 A | | 11/1999 | Lalezari et al. | |
| 6,121,938 A | | 9/2000 | Longshore et al. | |
| 6,181,288 B1 | | 1/2001 | Ivanov et al. | |
| 6,323,825 B1 | | 11/2001 | Zidek et al. | |
| 6,335,699 B1 | * | 1/2002 | Honma | 342/4 |
| 6,476,771 B1 | | 11/2002 | McKinzie, III | |
| 6,661,368 B1 | * | 12/2003 | Allen et al. | 342/25 |
| 6,674,392 B1 | * | 1/2004 | Schmidt et al. | 342/70 |
| 2002/0097190 A1 | | 7/2002 | Wu et al. | |
| 2002/0126062 A1 | * | 9/2002 | Matthews | 343/795 |

FOREIGN PATENT DOCUMENTS

| | | | | |
|---|---|---|---|---|
| EP | 447018 A1 | * | 9/1991 | H01Q/21/00 |
| EP | 0470271 B1 | | 7/1994 | |
| EP | 1118872 A2 | | 7/2001 | |
| JP | 61296287 A | * | 12/1986 | G01S/13/88 |
| WO | WO 00/28622 A1 | | 5/2000 | |

* cited by examiner

*Primary Examiner*—John B. Sotomayer
*Assistant Examiner*—Isam Alsomiri
(74) *Attorney, Agent, or Firm*—Stetina Brunda Garred & Brucker

(57) ABSTRACT

There is provided a radar system for protecting a radar compartment from a transmitted radar beam. The radar system comprises an antenna having a transmitter surface for transmitting the radar beam. There is further provided a protective member having an outer protective surface. This protective member is externally located adjacent the antenna for protecting the radar compartment from the transmitted radar beam. In addition, an alignment member is disposed between the antenna and the protective member. The alignment member is sized and configured to align the transmitter surface towards the outer protective surface for guiding the transmission of the radar beam therethrough. By featuring these components in such an arrangement, an operating frequency of any portion of the transmitted radar beam which diffracts from the outer protective surface can be mitigated to protect the radar compartment therefrom.

43 Claims, 3 Drawing Sheets

RF SHIELDING ELIMINATION FOR LINEAR ARRAY SAR RADAR SYSTEMS

STATEMENT RE: FEDERALLY SPONSORED RESEARCH/DEVELOPMENT

This invention was made with Government support under contract F34601-95-C-0694 awarded by the United States Government. The Government has certain rights in this invention.

CROSS-REFERENCE TO RELATED APPLICATIONS

Not Applicable

BACKGROUND OF THE INVENTION

The present invention relates generally to radar systems, and more particularly to an improved radar system which utilizes its protective member externally from the antenna to protect its operating radar compartment against the harmful effects of transmitted radar beam diffractions or scatters.

It is commonly understood that radio frequency waves generated from high power antennas have harmful or adverse effects upon humans and certain sensitive electronic components. In order to address this concern, various federal governmental agencies such as Occupational Safety and Health Agency (OSHA) and the like have set up a standardized minimum which regulates the amount of radio frequency waves that a person may be exposed to. Truly, the existence of such regulations clearly recognizes the dangers associated with high powered or intensified radio frequency waves.

One particular industry which is greatly concerned with such dangers is the radar technology industry. As radar facilities and installations typically use radio frequency waves to detect potential hostile threats and/or to identify unknown objects, they are oftentimes exposed to the harms posed by these waves. Of significance is the part of the radio frequency waves which diffracts or scatters backward and enters into the radar facilities and installations which obviously presents to be the most harm.

As such, any personnel working within these radar facilities and installations may undesirably become subjected to the negative effects of the radio frequency waves. In addition to such biological danger, the radio frequency waves may further detriment or interfere with certain electronic components that are sensitive to them. Consequently, preventing radar frequency reentry has always been a primary objective and interest in the radar technology industry.

Various measures have been proposed in the industry to alleviate the problems of radio frequency exposures. One widely and commonly accepted method against radio frequency exposure has been the use of extensive shielding around the walls, floors and ceilings of radar facilities and installations. More specifically, those sections of the radar facilities and installations are typically constructed of copper and/or silver impregnated materials which are often accompanied by elaborate grounding schemes. This technique is deployed to limit functional access in radar facilities and installations.

However, such method against radio frequency exposure is very expensive and time-consuming to construct and implement. This burden is enhanced by the circumstance that the associated maintenance required for such shielding frequently leads to the further effectuation of those same undesired characteristics. As such, the task of shielding the radar facilities and installations against radio frequency waves have always been arduous as both to time and cost.

Thus, there has long been a need in the industry, and in the radar technology industry in particular, for a radar system which can effectively protect radar facilities and installations against radio frequency exposure without undertaking the significant financial burden associated therewith. In addition, there exists a need for a radar system which can afford such radio frequency protection while avoiding the overwhelming construction, implementation and maintenance time that typically characterize the analogous systems of the prior art.

The present invention addresses and overcomes the above-described deficiencies by providing a radar system which comprises and utilizes a protective member externally from a transmitting antenna for the purpose of protecting its operating radar compartment against the harmful effects of transmitted radar beam (e.g., radio frequency beam) diffractions or scatters. In this respect, the radar system of the present invention offers an effective solution against radar beam reentry while eliminating the need to incur considerable expense and time which cloud its prior art counterparts.

BRIEF SUMMARY OF THE INVENTION

In accordance with the present invention, there is provided a radar system for protecting a radar compartment from a transmitted radar beam. The radar system comprises an antenna having a transmitter surface for transmitting the radar beam. There is further provided a protective member having an outer protective surface. This protective member is externally located adjacent the antenna for protecting the radar compartment from the transmitted radar beam. Calculations used through the remainder of this document are based on a frequency of 16 GHz, this technique is easily applied to other frequencies.

In addition, an alignment member is disposed between the antenna and the protective member. The alignment member is sized and configured to align the transmitter surface towards the outer protective surface for guiding the transmission of the radar beam therethrough. By featuring these components in such an arrangement, an operating frequency of any portion of the transmitted radar beam which diffracts from the outer protective surface can be mitigated to protect the radar compartment therefrom.

More specifically, the antenna is preferably a synthetic aperture radar antenna. The transmitting surface may comprise at least one transmitter formed thereon. Furthermore, the protective member preferably has a generally rectangular configuration. In the preferred embodiment, the protective member is a radome panel.

In accordance with the present invention, the protective member may be fabricated from a material which is substantially transparent to the radar beam. Preferably, such material is fiberglass impregnated with $S_2$ epoxy. The protective member may be fabricated from a plurality of plies. In the preferred embodiment, twenty plies may be used to fabricate the protective member. The protective member may have a certain thickness which may range from about 0.160 inches to 0.19 inches.

In the preferred embodiment, the alignment member is fabricated from a metallic material such as aluminum or steel. The alignment member may be engaged to the transmitter surface. For such engagement, the alignment member may comprise a plurality of mounting brackets and the transmitter surface may comprise a corresponding number of mounting bolts. The mounting brackets may be sized and configured to connect with the mounting bolts to engage the alignment member to the transmitter surface.

In particular, the alignment member has an alignment edge which may extend away from the transmitter surface of the antenna. The at least one transmitter formed on the transmitter surface may extend through the alignment member within the alignment edge thereof. In the preferred embodiment, the outer protective surface and the alignment edge are separated from each other within a distance generally less than one wavelength interval of the operating frequency. Such distance of separation between the outer protective surface and the alignment edge must be within about 0.738 inches, for the 16 GHz example.

Moreover, the protective member has an inner protective surface which faces toward the at least one transmitter. Preferably, the inner protective surface and the at least one transmitter are separated from each other within a distance equivalent to three wavelength intervals of the operating frequency. Such distance of separation between the inner protective surface and the at least one transmitter may be within about 2.214 inches.

In accordance with the present invention, the radar beam is a non-ionizing radio frequency beam. Further preferably, the operating frequency is about 16 gigahertz, but not limited to this frequency. Components physical sizes at longer wavelengths may grow too large for feasible construction and assembly.

BRIEF DESCRIPTION OF THE DRAWINGS

These as well as other features of the present invention will become more apparent upon reference to the drawings wherein.

DETAILED DESCRIPTION OF THE INVENTION

Figure 1:
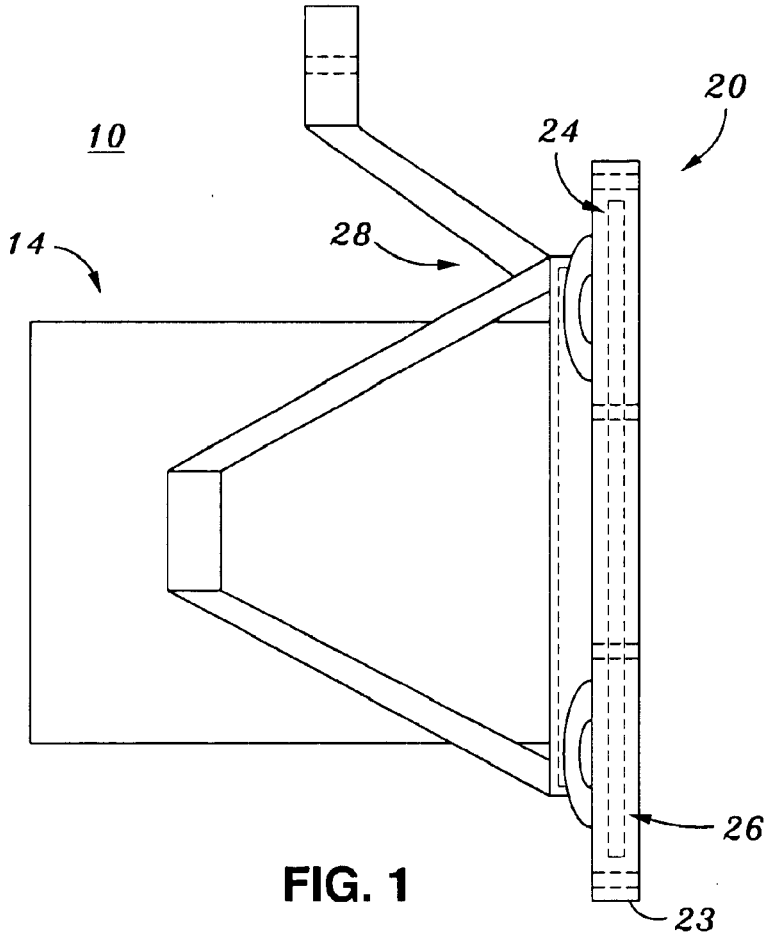
FIG. 1 is a side view of a radar system constructed in accordance with a preferred embodiment of the present invention and illustrating the manner in which its antenna, alignment member and protective member are installed with respect to each other.

Referring now to the drawings wherein the showings are for purposes of illustrating preferred embodiments of the present invention only, and not for purposes of limiting the same, FIG. 1 illustrates a radar system 10 constructed in accordance with a preferred embodiment of the present invention. The radar system 10 is essentially designed to protect its operating radar compartment (not shown) against the harmful effects of transmitted radar beam diffractions or scatters. For purposes of this patent, the term "radar compartment" should be construed broadly to include any radar operational unit such as a ground or shipboard based radar facility, a radar installation, an antenna bay in a shipboard or airborne vehicle, or the like.

Figure 5:
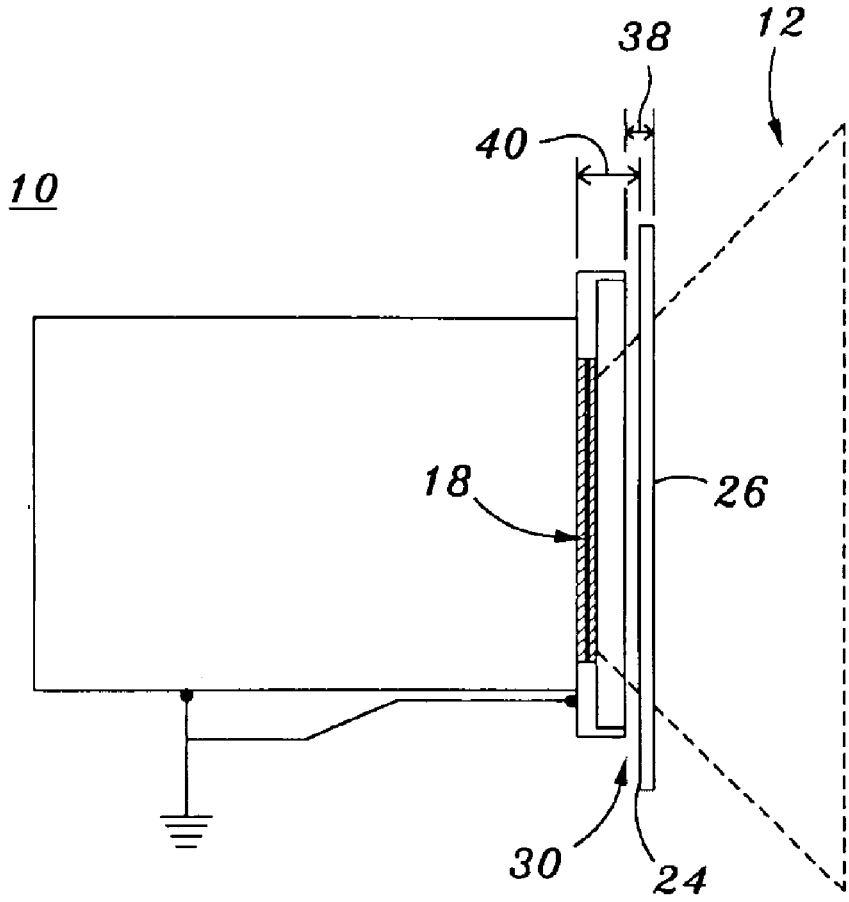
FIG. 5 is a side view of the radar system shown in FIG. 1 and illustrating the specific distancing requirements of its protective member with respect to the alignment member and the antenna.

Referring more particularly to FIGS. 1 and 5, the radar system 10 of the present invention may be formed from multiple components and have a variety of shapes, configurations, geometries and textures which are suitable in protecting personnel and sensitive electronic components within the radar compartment against the dangers of transmitted radar beam diffractions or scatters. Although the radar system 10 may be contemplated to be used with various types of radar beams, the radar system 10 of the present invention is preferably used for protection against transmitted radio frequency beams 12, mainly its diffractions or scatters.

Figure 2:
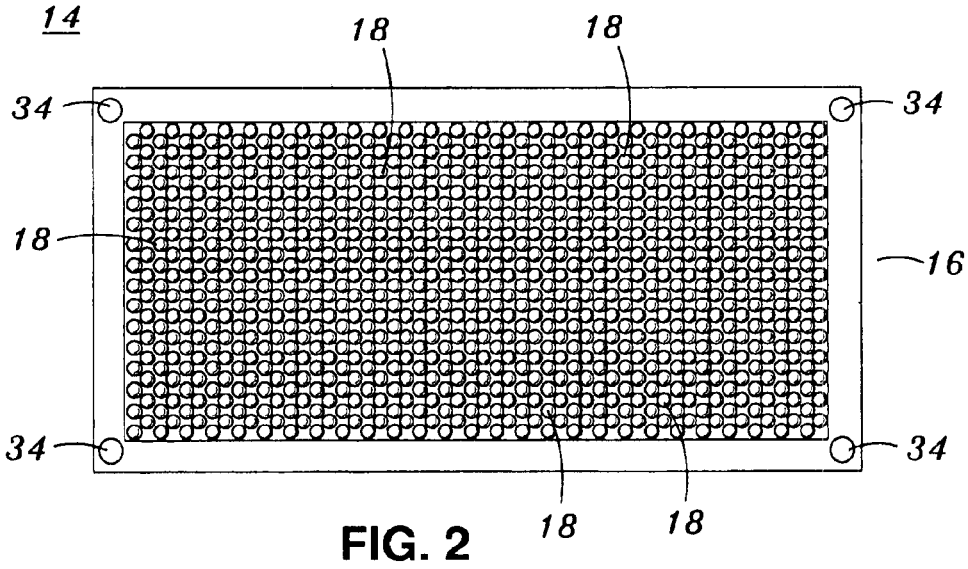
FIG. 2 is a front view of the antenna shown in FIG. 1 and illustrating a plurality of transmitters which are formed on its transmitting surface for transmitting a radar beam therefrom.

Referring now to FIGS. 1 and 2, the radar system 10 of the present invention first features an antenna 14 adapted to transmit radar beams therefrom. Preferably, this antenna 14 is a synthetic aperture radar antenna, and more preferably a low power end-fire linear synthetic aperture radar antenna. As noted above, the preferred antenna 14 utilized in the present invention is designed to transmit radio frequency beams 12 toward a designated target to ultimately perform their designated tasks (e.g., detecting potential hostile threats and/or identifying unknown objects). In the preferred embodiment, the transmitted radio frequency beams 12 have an operating frequency of about 16 gigahertz.

Although the antenna 14 may be characterized by different configurations and shapes, the antenna 14 preferably has a generally rectangular configuration as shown in the provided figures. However, it should be noted herein that generally circular, ellipsoidal or other forms of configuration may be accommodated. A substantially flat and rectangular transmitter surface 16 is defined on one of the sides of the antenna 14. The transmitter surface 16 includes a plurality of transmitters 18 formed thereon for transmitting the radio frequency beam 12 in the preferred operating frequency range. Optionally, the antenna 14 may be engaged to a movable fixture (not shown) such as an overhead trolley fixture to optimize its positioning or movement.

Figure 4:
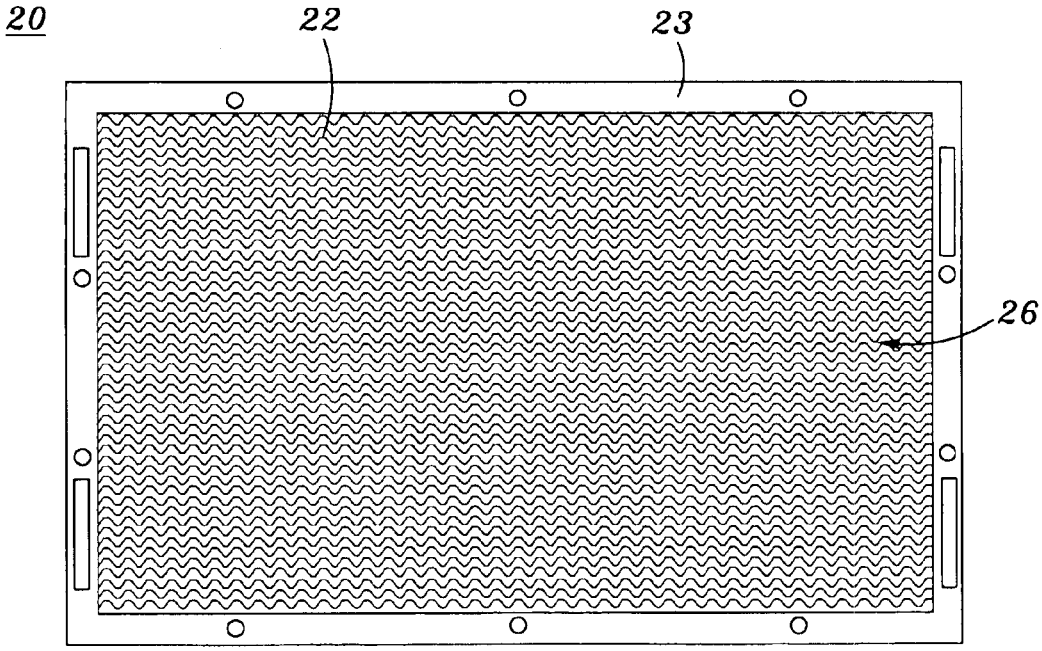
FIG. 4 is a front view of the protective member shown in FIG. 1 and illustrating its protective surface which is specially fabricated from a plurality of individual plies.

As illustrated in FIGS. 1 and 4, the radar system 10 of the present invention also features a protective member 20, an external radome, for protecting the radar compartment from the radio frequency beams 12 transmitted from the antenna 14. This protective member 20 is a wholly separate component of the system 10 which is externally located apart from the antenna 14. In the preferred embodiment, the protective member 20 is a radome panel defining a generally rectangular configuration. However, it should not be limited to such shape as other forms of configuration may be possible.

The protective member 20 used in the present invention may be fabricated from any material which is substantially transparent to the radio frequency beams 12. Although many types of material may fit this description, the protective member 20 is preferably comprised of a plurality of plies 22 which are fabricated from fiberglass impregnated with $S_2$ epoxy. A solid protective frame edging 23 may be optionally provided around the plurality of plies 22.

More specifically, multiple plies 22 (e.g., twenty plies) are layered together until a desired thickness of the protective member 20 is reached. In the preferred embodiment of the present invention, the desired thickness range from an inner protective surface 24 to an outer protective surface 26 of the protective member 20 is from about 0.160 inches to 0.19 inches, wherein the desired thickness from that range is about 0.163 inches. The importance of the protective member thickness will be discussed later in the application.

Figure 3:
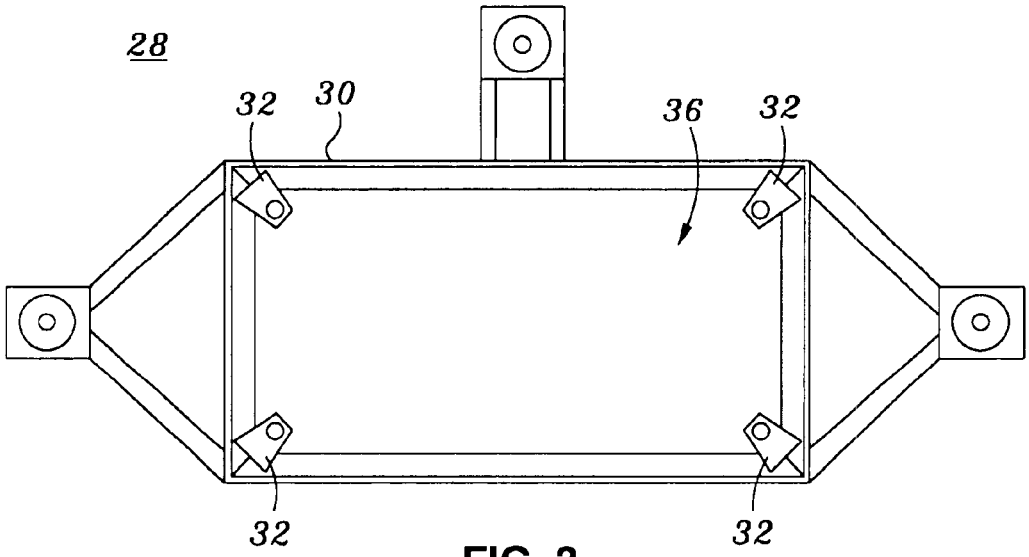
FIG. 3 is a front view of the alignment member shown in FIG. 1 and illustrating its mounting brackets which are utilized for engaging the antenna shown in FIG. 2.

Referring now to FIGS. 1 and 3, the radar system 10 of the present invention further includes an alignment member 28. The alignment member 28 is primarily sized and configured to align the transmitter surface 16 of the antenna 14 towards the protective member 20 so as to guide the transmission of the radio frequency beams 12 through the outer protective surface 26 thereof. In order to properly accomplish such alignment, the alignment member 28 is disposed between the antenna 14 and the protective member 20. Although the alignment member 28 may be variously materialized, it is preferably fabricated from a metallic material such as aluminum, steel, or other conductive material. Moreover, the alignment member 28 preferably has a generally rectangular configuration similar to the configuration of the transmitter surface 16 of the antenna 14.

In particular, the alignment member 28 is engaged to the transmitter surface 16 of the antenna 14 and has an alignment edge 30 which substantially extends away from the transmitter surface 16. More particularly, the alignment member 28 has a plurality of mounting brackets 32 adjacent its alignment edge 30. Each of the mounting brackets 32 can connect to a corresponding mounting bolt 34 located on the transmitter surface 16 of the antenna 14.

Upon such engagement through the use of complimenting mounting brackets and bolts 32, 34, the transmitters 18 formed on the transmitter surface 16 are extended through a spacing or void 36 provided within the alignment edge 30 of the alignment member 28. Of course, as described above, the alignment member 28 should engage the antenna 14 in a manner as to point the transmitters 18 toward the protective member 20. It should be noted herein that the protective member 20 may become connected to the alignment edge 30 of the alignment member 28, or simply be disposed adjacent thereto.

In addition to the above-defined arrangement and engagement, certain distancing requirements must be respected. More specifically, the outer protective surface 26 and the alignment edge 30 should be separated from each other within a distance 38 which is equivalent to slightly less than one wavelength interval of the operating frequency. In terms of a numerical measurement, the amount of distance 38 between them is within about 0.738 inches.

Furthermore, the separation between the inner protective surface 24 and the transmitters 18 should be at a distance 40 which is equivalent to about three wavelength intervals of the operating frequency, or 2.214 inches in numerical measurement. Alternatively, such distance 40 between the inner protective surface 24 and the transmitters 18 may be modified to next consecutive odd wavelength intervals such as five or seven wavelength intervals which would respectively yield a distance of about 3.690 and 5.166 inches.

The radar system 10 of the present invention essentially utilizes radio frequency wave tunnel cutoff schemes to avoid radio frequency reentry into the radar compartment. The relationship among the three essential components of the radar system 10 as defined above are arranged such that all radio frequency beams 12 are projected out of, absorbed, and clipped off and prevented reentry into the radar compartment. Simply put, radar beam scattering, deflection, diffraction and absorption are accounted for by the radar system 10 of the present invention. As a safety precaution, radio frequency room area RF hazard sensors may be optionally tied into a power cutoff circuit to the radar system 10 as a precaution for catastrophic waveguide failure, misalignment or other unforeseen failure causing radio frequency reentry into the radar compartment.

As shown in FIGS. 1 and 5, the transmitters 18 of the antenna 14 are configured to transmit radar frequency beams 12 through the inner and outer protective surfaces 24, 26 of the protective member 20. As discussed previously, such guidance of the transmitted beams 12 is primarily facilitated through the cooperative use of the alignment member 28 which directs the transmitters 18 toward the protective member 20. Due to the specified operating frequency (i.e., 16 gigahertz) and the thickness (i.e., 0.163 inches) of the protective member 20, a 180 degree phase reversal may be achieved which effectively reduces the power-reflection coefficient to near zero. The power loss for one-way transmission of the radio frequency beams 12 through the protective member 20 may be shown by the following equation:

Dissipation Loss

Equation: $dB=2.31f\ sqrt(\epsilon r)\tau\ tan\delta$

| | |
|---|---|
| f | 16 GHz Freq. |
| $\epsilon r$ | 4.35 Di-electric permittivity |
| $tan\delta$ | 0.02 |
| t | 0.163 protective member thickness |

0.29 dB Power loss—One way

In this respect, the power loss for one-way is about 0.29 dB. This leads to the conclusion that protective member characteristics are near 0.58 dB two-way power loss. This is part of the key which makes this technique feasible. As such, any radio frequency beams 12 that diffract or scatter back from the outer protective surface 26 of the protective member 20 may be mitigated to protect the radar compartment from the harmful effects of the radio frequency beams 12.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. A radar system for protecting a radar compartment from a transmitted radar beam, the system comprising:

an antenna having a transmitter surface for transmitting the radar beam;

a protective member having an outer protective surface and being externally located adjacent the antenna for protecting the radar compartment from the transmitted radar beam, the protective member being fabricated from a material substantially transparent to the radar beam; and an alignment member disposed between the antenna and the protective member, the alignment member being sized and configured to align the transmitter surface towards the outer protective surface for transmission of the radar beam therethrough;

wherein the radar system is configured such that an operating frequency of any portion of the transmitted radar beam diffracting back towards the radar compartment from the outer protective surface is mitigated to protect the radar compartment from the diffracted portion of the transmitted radar beam.

2. The system of claim 1 wherein the antenna is a synthetic aperture radar antenna.

3. The system of claim 1 wherein the transmitting surface comprises at least one transmitter formed thereon.

4. The system of claim 1 wherein the protective member has a generally rectangular configuration.

5. The system of claim 1 wherein the protective member is a radome panel.

6. The system of claim 1 wherein the material is fiberglass impregnated with $S_2$ epoxy.

7. The system of claim 1 wherein the protective member is fabricated from a plurality of plies.

8. The system of claim 7 wherein the plurality of plies comprises twenty plies.

9. The system of claim 1 wherein the protective member has a thickness ranging from about 0.160 inches to 0.1 inches.

10. The system of claim 1 wherein the alignment member is fabricated from a metallic material.

11. The system of claim 10 wherein the metallic material is aluminum.

12. The system of claim 10 wherein the metallic material is steel.

13. The system of claim 1 wherein the alignment member is engaged to the transmitter surface and having an alignment edge extending away therefrom.

14. The system of claim 13 wherein the transmitter surface has at least one transmitter extending through the alignment member within the alignment edge thereof.

15. The system of claim 14 wherein the protective member has an inner protective surface facing towards the at least one transmitter, the inner protective surface and the at least one transmitter being separated from each other within a distance equivalent to three wavelength intervals of the operating frequency.

16. The system of claim 15 wherein the distance of separation between the inner protective surface and the at least one transmitter is within about 2.214 inches.

17. The system of claim 13 wherein the alignment member comprises a plurality of mounting brackets and the transmitter surface comprises a corresponding number of mounting bolts, the mounting brackets being sized and configured to connect with the mounting bolts for engaging the alignment member to the transmitter surface.

18. The system of claim 13 wherein the outer protective surface and the alignment edge are separated from each other within a distance equivalent to generally less than one wavelength interval of the operating frequency.

19. The system of claim 18 wherein the distance of separation between the outer protective surface and the alignment edge is within about 0.738 inches.

20. The system of claim 1 wherein the radar beam is a radio frequency beam.

21. The system of claim 1 wherein the operating frequency is about 16 gigahertz.

22. A method of protecting a radar compartment from a transmitted radar beam with a radar system having an alignment member and a protective member defining an outer protective surface, the protective member being fabricated from a material that is substantially transparent to the radar beam, the method comprising the steps of:

a) aligning an antenna towards the outer protective surface of the protective member with the alignment member disposed therebetween;

b) transmitting a radar beam from the antenna outwardly through the outer protective surface;

c) diffracting a portion of the outwardly transmitted radar beam from the outer protective surface; and d) mitigating an operating frequency of the portion of the radar beam that is diffracted from the outer protective surface in order to protect the radar compartment from the diffracted portion of the transmitted radar beam.

23. The method of claim 22 wherein step a) comprises:

1) defining an alignment edge of the alignment member; and 2) separating the outer protective surface and the alignment edge from each other within a distance generally less than one wavelength interval of the operating frequency.

24. The method of claim 23 wherein the distance of separation between the outer protective surface and the alignment edge in step 2) is within about 0.738 inches.

25. The method of claim 22 wherein step a) comprises:

1) defining at least one transmitter of the antenna;

2) defining an inner protective surface of the protective member; and 3) separating the inner protective surface and the at least one transmitter from each other within a distance equivalent to three wavelength intervals of the operating frequency.

26. The method of claim 25 wherein the distance of separation between the inner protective surface and the at least one transmitter in step 3) is within about 2.214 inches.

27. The method of claim 22 wherein the antenna in step a) is a synthetic aperture radar antenna.

28. The method of claim 22 wherein the protective member in step a) is a radome panel.

29. The method of claim 22 wherein the alignment member in step a) is fabricated from a material chosen from the group consisting of aluminum, steel and other conductive material.

30. The method of claim 22 wherein the radar beam in step b) is a radio frequency beam.

31. The method of claim 22 wherein the operating frequency in step d) is about 16 gigahertz.

32. A radar system for protecting a radar compartment from a transmitted radar beam, the system comprising:

an antenna having a transmitter surface for transmitting the radar beam;

a protective member having an outer protective surface and being externally located adjacent the antenna for protecting the radar compartment from the transmitted radar beam, the protective member being fabricated from fiberglass impregnated with $S_2$ epoxy that is substantially transparent to the radar beam; and an alignment member disposed between the antenna and the protective member, the alignment member being sized and configured to align the transmitter surface towards the outer protective surface for transmission of the radar beam therethrough;

wherein an operating frequency of any portion of the transmitted radar beam diffracting from the outer protective surface is mitigated to protect the radar compartment therefrom.

33. A radar system for protecting a radar compartment from a transmitted radar beam, the system comprising:

an antenna having a transmitter surface for transmitting the radar beam;

a protective member having an outer protective surface and being externally located adjacent the antenna for protecting the radar compartment from the transmitted radar beam, the protective member being fabricated from twenty plies of material; and an alignment member disposed between the antenna and the protective member, the alignment member being sized and configured to align the transmitter surface towards the outer protective surface for transmission of the radar beam therethrough;

wherein an operating frequency of any portion of the transmitted radar beam diffracting from the outer protective surface is mitigated to protect the radar compartment therefrom.

34. A radar system for protecting a radar compartment from a transmitted radar beam, the system comprising:

an antenna having a transmitter surface for transmitting the radar beam;

a protective member having an outer protective surface and being externally located adjacent the antenna for protecting the radar compartment from the transmitted radar beam; and an alignment member disposed between the antenna and the protective member, the alignment member being engaged to the transmitter surface and having an alignment edge extending away therefrom, the alignment member being sized and configured to align the transmitter surface towards the outer protective surface for transmission of the radar beam therethrough;

wherein an operating frequency of any portion of the transmitted radar beam diffracting from the outer protective surface is mitigated to protect the radar compartment therefrom.

35. The system of claim 34 wherein the transmitter surface has at least one transmitter extending through the alignment member within the alignment edge thereof.

36. The system of claim 34 wherein the outer protective surface and the alignment edge are separated from each other within a distance equivalent to generally less than one wavelength interval of the operating frequency.

37. The system of claim 36 wherein the distance of separation between the outer protective surface and the alignment edge is within about 0.738 inches.

38. The system of claim 35 wherein the protective member has an inner protective surface facing towards the at least one transmitter, the inner protective surface and the at least one transmitter being separated from each other within a distance equivalent to three wavelength intervals of the operating frequency.

39. The system of claim 38 wherein the distance of separation between the inner protective surface and the at least one transmitter is within about 2.214 inches.

40. A method of protecting a radar compartment from a transmitted radar beam with a radar system having an alignment member and a protective member defining an outer protective surface, the method comprising the steps of:

a) defining an alignment edge of the alignment member;

b) aligning an antenna towards the outer protective surface of the protective member such that the outer protective surface and the alignment edge are separated from each other within a distance generally less than one wavelength interval of the operating frequency;

c) transmitting a radar beam from the antenna through the outer protective surface;

d) diffracting a portion of the radar beam from the outer protective surface; and e) mitigating an operating frequency of the diffracted portion of the radar beam to protect the radar compartment therefrom.

41. The method of claim 40 wherein the distance of separation between the outer protective surface and the alignment edge in step b) is within about 0.738 inches.

42. The method of claim 40 wherein step a) comprises:

1) defining at least one transmitter of the antenna;

2) defining an inner protective surface of the protective member; and 3) separating the inner protective surface and the at least one transmitter from each other within a distance equivalent to three wavelength intervals of the operating frequency.

43. The method of claim 42 wherein the distance of separation between the inner protective surface and the at least one transmitter in step 3) is within about 2.214 inches.

* * * * *